US009534398B2

(12) United States Patent
Rainey

(10) Patent No.: US 9,534,398 B2
(45) **Date of Patent: *Jan. 3, 2017**

(54) PATTERNED TILES AND FLOOR COVERINGS COMPRISING SAME

(71) Applicant: COLUMBIA INSURANCE COMPANY, Omaha, NE (US)

(72) Inventor: Pamela Managan Rainey, Cartersville, GA (US)

(73) Assignee: COLUMBIA INSURANCE COMPANY, Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/136,168

(22) Filed: Apr. 22, 2016

(65) Prior Publication Data

US 2016/0237693 A1 Aug. 18, 2016

Related U.S. Application Data

(63) Continuation of application No. 14/197,854, filed on Mar. 5, 2014, now Pat. No. 9,340,982.

(60) Provisional application No. 61/779,585, filed on Mar. 13, 2013.

(51) Int. Cl.

| | |
|---|---|
| ***E04F 15/02*** | (2006.01) |
| ***E04F 13/08*** | (2006.01) |
| ***D06N 7/00*** | (2006.01) |
| ***E04F 15/10*** | (2006.01) |

(52) U.S. Cl.

CPC ..... *E04F 15/02* (2013.01); *D06N 7/0028* (2013.01); *E04F 13/0871* (2013.01); *E04F 15/10* (2013.01)

(58) Field of Classification Search

CPC ..... E04F 15/02; E04F 15/10; E04F 13/0871; E04F 13/08; D06N 7/0028; D06N 7/00

See application file for complete search history.

(56) References Cited

U.S. PATENT DOCUMENTS

| | | | | |
|---|---|---|---|---|
| 1,453,728 A * | 5/1923 | Rhodes | B44F 3/00 273/157 R |
| 1,637,580 A | 8/1927 | Abel et al. | |
| 2,641,043 A * | 6/1953 | Martin | E04G 11/22 249/191 |
| 2,715,289 A | 8/1955 | Gale | |
| 3,067,701 A | 12/1962 | Wilcox | |

(Continued)

FOREIGN PATENT DOCUMENTS

| | | |
|---|---|---|
| BE | 1005677 A3 | 12/1993 |
| CN | 1162045 | 10/1997 |

(Continued)

OTHER PUBLICATIONS

US. Appl. No. 61/779,585, filed Mar. 13, 2013, Rainey (Shaw Industries Group).

(Continued)

*Primary Examiner* — Jeanette E Chapman
(74) *Attorney, Agent, or Firm* — Ballard Spahr LLP

(57) ABSTRACT

A tile having a contrast pattern intermixed with a portion of a background pattern. The contrast pattern is positioned proximate a selected corner of the tile and has a contrast color different than the colors of the background pattern. Within a surface covering, the rotational position of the tile can be varied to thereby achieve a desired visual appearance with respect to the contrast patterns of adjacent tiles.

23 Claims, 10 Drawing Sheets

(56) References Cited

U.S. PATENT DOCUMENTS 3,216,469 A 11/1965 New
3,241,509 A 3/1966 Short
3,582,436 A 6/1971 Bucher
3,741,786 A 6/1973 Torrey
3,748,211 A 7/1973 Hoopengardner
3,799,549 A 3/1974 Laker
3,813,275 A 5/1974 Hesener et al.
3,839,127 A 10/1974 Hazuka et al.
3,850,783 A 11/1974 Peters et al.
3,875,716 A 4/1975 Eusemann
3,969,181 A 7/1976 Seabold
4,055,868 A 11/1977 O'Neill, Jr.
4,133,152 A 1/1979 Penrose
4,148,678 A 4/1979 Fogle et al.
4,151,039 A 4/1979 Lash
4,242,389 A 12/1980 Howell
4,336,097 A 6/1982 Van Kampen et al.
4,370,937 A 2/1983 Denny
4,373,730 A * 2/1983 Koltz ..... A63F 9/0613 273/155
4,546,025 A 10/1985 Vaisman
4,557,774 A 12/1985 Hoopengardner
4,581,091 A 4/1986 Lane
4,613,396 A 9/1986 Scarborough
4,681,481 A 7/1987 Kapusta
4,797,170 A 1/1989 Hoopengardner
D299,971 S * 2/1989 Gilbert ..... D25/138
4,880,490 A 11/1989 MacIntyre
4,889,572 A 12/1989 Danico et al.
5,002,425 A 3/1991 Ortiz Bordallo
5,011,411 A * 4/1991 Loewy ..... G09B 1/34 434/72
D333,678 S 3/1993 Lissoni
5,249,884 A 10/1993 Widmer
5,290,390 A 3/1994 Roman et al.
5,314,554 A 5/1994 Owens
5,376,419 A 12/1994 Foster et al.
5,403,414 A 4/1995 Corston
5,456,792 A 10/1995 Rodriguez et al.
5,482,182 A 1/1996 Thompson et al.
5,582,675 A 12/1996 Stepanek
5,693,395 A 12/1997 Wine
5,863,632 A 1/1999 Bisker
D425,633 S 5/2000 Hunter
6,159,328 A 12/2000 Gaikoski et al.
6,305,688 B1 10/2001 Waroway
6,790,042 B2 9/2004 Worth
6,802,164 B1 10/2004 Newbrough et al.
6,841,216 B2 1/2005 Daniel et al.
6,908,656 B2 6/2005 Daniel et al.
6,945,007 B2 9/2005 Kobayashi et al.
7,021,304 B1 4/2006 Houston
7,070,846 B2 7/2006 Beistline et al.
7,083,841 B2 8/2006 Oakey et al.
7,114,542 B2 10/2006 Pelligra
7,116,843 B1 10/2006 Wensley et al.
7,198,086 B2 4/2007 Dusich
7,297,385 B2 11/2007 Daniel et al.
7,305,647 B1 12/2007 Pelham
7,341,772 B2 3/2008 Guess
7,350,443 B2 4/2008 Oakey et al.
7,669,631 B2 3/2010 Bailey et al.
7,673,378 B1 3/2010 Weiner
7,765,653 B1 8/2010 Weiner
7,968,165 B2 6/2011 Barnes
D645,982 S 9/2011 Amend
8,145,345 B2 3/2012 Magee et al.
8,155,776 B2 4/2012 Bittner et al.
8,361,581 B2 1/2013 Tick et al.
8,644,976 B2 2/2014 Bittner et al.
D701,325 S * 3/2014 MacDonald ..... D25/113
8,769,897 B2 7/2014 Kikuchi et al.
8,898,879 B2 12/2014 Hussmann
9,340,982 B2 5/2016 Rainey
2002/0136855 A1 9/2002 Daniel et al.
2003/0037508 A1 2/2003 Kobayashi et al.
2003/0071051 A1 4/2003 Martinsen
2003/0118774 A1 6/2003 Tippett et al.
2003/0136069 A1 7/2003 Geissler
2003/0190450 A1 10/2003 Daniel et al.
2004/0045240 A1 3/2004 McIlvaine
2004/0253408 A1 12/2004 Hutchison
2005/0005550 A1* 1/2005 Schrunk ..... B44F 1/10 52/385
2005/0048253 A1 3/2005 Nord et al.
2005/0166498 A1 8/2005 Oakey et al.
2005/0210791 A1 9/2005 Oakey et al.
2005/0249924 A1 11/2005 Reichwein et al.
2005/0252132 A1 11/2005 Sieber et al.
2006/0040089 A1 2/2006 Daniel et al.
2006/0240210 A1 10/2006 Daniel et al.
2006/0251846 A1 11/2006 Daniel et al.
2006/0275578 A1 12/2006 Jones
2007/0260352 A1 11/2007 Magee et al.
2008/0041286 A1 2/2008 Tick et al.
2008/0120934 A1* 5/2008 Lategana ..... B32B 5/22 52/378
2008/0176019 A1 7/2008 Bragdon
2008/0193698 A1 8/2008 Oakey et al.
2008/0294272 A1 11/2008 Bittner et al.
2009/0095428 A1 4/2009 Schwertfeger et al.
2009/0202778 A1 8/2009 McGee
2009/0260307 A1 10/2009 Thiers
2009/0304974 A1 12/2009 Tick et al.
2010/0086722 A1 4/2010 Barnes
2010/0272943 A1 10/2010 Ddamulira et al.
2010/0300625 A1 12/2010 Hardy
2010/0323169 A1 12/2010 Son et al.
2010/0330327 A1 12/2010 Oakey et al.
2012/0114914 A1 5/2012 Tick et al.
2013/0222423 A1 8/2013 Fields et al.
2013/0316117 A1 11/2013 Tick, Jr. et al.
2014/0037885 A1 2/2014 Oakey
2014/0109502 A1 4/2014 Bittner et al.

FOREIGN PATENT DOCUMENTS

CN 1729899 A 2/2006
CN 2793202 7/2006
CN 104042095 9/2014
DE 3328528 6/1985
DE 3634764 A1 * 4/1988 ..... B44C 3/123
GB 1007281 A 10/1965
JP 02-274958 11/1990
JP 02-274959 11/1990
JP H0716141 A 1/1995
JP H07317290 A 12/1995
JP 2005-325665 A 11/2005
JP 2008183167 A 8/2008
JP 2010259649 A 11/2010
KR 20110113953 10/2011
WO WO-9001411 A1 2/1990
WO WO-00/77111 A2 12/2000
WO WO-02/064879 A2 8/2002
WO WO-03103944 A1 12/2003
WO WO-2006/044928 A2 4/2006
WO WO-2007/030320 3/2007
WO WO-2009/148423 A1 12/2009
WO WO-2010/018425 A1 2/2010
WO WO-2010/144902 A2 12/2010
WO WO 2010144897 A1 * 12/2010 ..... A47G 27/02
WO WO-2010144897 A1 12/2010

OTHER PUBLICATIONS

Final Office Action issued on Sep. 30, 2015 by the U.S. Patent & Trademark Office for U.S. Appl. No. 13/526,155, filed Jun. 18, 2012 and published as US-2013-0230682 on Sep. 5, 2013 (Applicant—Columbia Insurance Co.//Inventor—Duncan, et al.) (14pages).

Non-Final Office Action issued on Jul. 23, 2014 by the U.S. Patent & Trademark Office for U.S. Appl. No. 14/197,854, filed Mar. 5, 2014 and published as US-2014-0260032-A1 on Sep. 18, 2014

(56) References Cited

OTHER PUBLICATIONS (Applicant—Columbia Insurance Co.//Inventor—Managan, etal.) (11 pages).
Non-Final Office Action issued on Jan. 30, 2015 by the U.S. Patent & Trademark Office for U.S. Appl. No. 14/197,854, filed Mar. 5, 2014 and published as US-2014-0260032-A1 on Sep. 18, 2014 (Applicant—Columbia Insurance Co.//Inventor—Managan, etal.) (13 pages).
Final Office Action issued on Sep. 22, 2015 by the U.S. Patent & Trademark Office for U.S. Appl. No. 14/197,854, filed Mar. 5, 2014 and published as US-2014-0260032-A1 on Sep. 18, 2014 (Applicant—Columbia Insurance Co.//Inventor—Managan, et al.)(26 pages).
First Examination issued Dec. 1, 2014 by the Australian Patent Office for application 2013201200 filed Mar. 1, 2013 (Applicant—Shaw Industries Group, Inc.//Inventor—Duncan et al.) (5 pages).
Second Examination issued Nov. 13, 2015 by the Australian Patent Office for application 2013201200 filed Mar. 1, 2013 (Applicant—Shaw Industries Group, Inc.//Inventor—Duncan et al.) (3 pages).
First Office Action issued by the Canadian Intellectual Property Office on May 7, 2014, for application CA 2,807,853, filed on Mar. 1, 2013 (Applicant—Shaw Industries Group, Inc.//Inventor—Duncan et al.) (2 pages).
Second Office Action issued by the Canadian Intellectual Property Office on Feb. 23, 2015, for application CA 2,807,853, filed on Mar. 1, 2013 (Applicant—Shaw Industries Group, Inc.//Inventor—Duncan et al.) (5 pages).
Examination Report issued Jul. 1, 2015 by the Intellectual Property Office of Singapore for application No. 2013015623, which was filed on Mar. 1, 2013 and published as 193132 on Sep. 30, 2013 (Applicant—Shaw Industries Group, Inc.//Inventor—Duncan et al.) (10 pages).
Non-Final Office Action issued on Sep. 19, 2012 by the U.S. Patent & Trademark Office for U.S. Appl. No. 13/526,155, filed Jun. 18, 2012, published as 2013-0230682 on Sep. 5, 2013 (Applicant—Columbia Insurance Co.//Inventor—Duncan, et al.) (9 pages).
Amendment in Response to Non-Final Office Action filed on Dec. 14, 2012 with the U.S. Patent & Trademark Office for U.S. Appl. No. 13/526,155, filed Jun. 18, 2012, published as 2013-0230682 on Sep. 5, 2013 (Applicant—Columbia Insurance Co.//Inventor—Duncan et al.) (16 pages).
Final Office Action issued on Feb. 11, 2013 by the U.S. Patent & Trademark Office for U.S. Appl. No. 13/526,155, filed Jun. 18, 2012, published as 2013-0230682 on Sep. 5, 2013 (Applicant—Columbia Insurance Co.//Inventor—Duncan, et al.) (9 pages).
Amendment in Response to Final Office Action filed on May 15, 2013 with the U.S. Patent & Trademark Office for U.S. Appl. No. 13/526,155, filed Jun. 18, 2012, published as 2013-0230682 on Sep. 5, 2013 (Applicant—Columbia Insurance Co.//Inventor—Duncan et al.) (18 pages).
Non-Final Office Action issued on Jul. 18, 2013 by the U.S. Patent & Trademark Office for U.S. Appl. No. 13/526,155, filed Jun. 18, 2012, published as 2013-0230682 on Sep. 5, 2013 (Applicant—Columbia Insurance Co.//Inventor—Duncan et al.) (13 pages).
Amendment in Response to Non-Final Office Action filed on Jan. 20, 2014 with the U.S. Patent & Trademark Office for U.S. Appl. No. 13/526,155, filed Jun. 18, 2012, published as 2013-0230682 on Sep. 5, 2013 (Applicant—Columbia Insurance Co.//Inventor—Duncan et al.) (20 pages).
Final Office Action issued on Apr. 11, 2014 by the U.S. Patent & Trademark Office for U.S. Appl. No. 13/526,155, filed Jun. 18, 2012, published as 2013-0230682 on Sep. 5, 2013 (Applicant—Columbia Insurance Co.//Inventor—Duncan et al.).
Amendment and Response to Final Office Action filed on Jun. 11, 2014 with the U.S. Patent & Trademark Office for U.S. Appl. No. 13/526,155, filed Jun. 18, 2012, published as 2013-0230682 on Sep. 5, 2013 (Applicant—Columbia Insurance Co.//Inventor—Duncan et al.) (12 pages).
Advisory Action issued Jun. 19, 2014 by the U.S. Patent & Trademark Office for U.S. Appl. No. 13/526,155, filed Jun. 18, 2012, published as 2013-0230682 on Sep. 5, 2013 (Applicant—Columbia Insurance Co.//Inventor—Duncan et al.) (4 pages).
Notice of Appeal filed Oct. 10, 2014 with the U.S. Patent & Trademark Office for U.S. Appl. No. 13/526,155, filed Jun. 18, 2012, published as 2013-0230682 on Sep. 5, 2013 (Applicant—Columbia Insurance Co.//Inventor—Duncan et al.) (1 page).
Amendment and Response to Final Office Action filed on Feb. 18, 2015 by the U.S. Patent & Trademark Office for U.S. Appl. No. 13/526,155, filed Jun. 18, 2012, published as 2013-0230682 on Sep. 5, 2013 (Applicant—Columbia Insurance Co.//Inventor—Duncan, et al.) (13 pages).
Non-Final Office Action issued on Mar. 20, 2015 by the U.S. Patent & Trademark Office for U.S. Appl. No. 13/526,155, filed Jun. 18, 2012, published as 2013-0230682 on Sep. 5, 2013 (Applicant—Columbia Insurance Co.//Inventor—Duncan et al.) (16 pages).
Amendment in Response to Non-Final Office Action filed on May 22, 2015 with the U.S. Patent & Trademark Office for U.S. Appl. No. 13/411,195, filed Mar. 2, 2012, published as 2013-0230681 on Sep. 5, 2013 (Applicant—Columbia Insurance Co.//Inventor—Duncan et al.) (14 pages).
Non-Final Office Action issued on Jul. 18, 2013 by the U.S. Patent & Trademark Office for U.S. Appl. No. 13/411,195, filed Mar. 2, 2012, published as 2013-0230681 on Sep. 5, 2013 (Applicant—Columbia Insurance Co.//Inventor—Duncan et al.) (16 pages).
Amendment in Response to Non-Final Office Action filed on Jan. 20, 2014 with the U.S. Patent & Trademark Office for U.S. Appl. No. 13/411,195, filed Mar. 2, 2012, published as 2013-0230681 on Sep. 5, 2013 (Applicant—Columbia Insurance Co.//Inventor—Duncan et al.) (23 pages).
Final Office Action issued on Apr. 11, 2014 by the U.S. Patent & Trademark Office for U.S. Appl. No. 13/411,195, filed Mar. 2, 2012, published as 2013-0230681 on Sep. 5, 2013 (Applicant—Columbia Insurance Co.//Inventor—Duncan et al.) (10 pages).
Amendment in Response to Final Office Action filed on Jun. 11, 2014 with the U.S. Patent & Trademark Office for U.S. Appl. No. 13/411,195, filed Mar. 2, 2012, published as 2013-0230681 on Sep. 5, 2013 (Applicant—Columbia Insurance Co.//Inventor—Duncan et al.) (15 pages).
Advisory Action issued on Jun. 19, 2014 by the U.S. Patent & Trademark Office for U.S. Appl. No. 13/411,195, filed Mar. 2, 2012, published as 2013-0230681 on Sep. 5, 2013 (Applicant—Columbia Insurance Co.//Inventor—Duncan et al.) (3 pages).
Notice of Appeal filed Oct. 10, 2014 with the U.S. Patent & Trademark Office for U.S. Appl. No. 13/411,195, filed Mar. 2, 2012, published as 2013-0230681 on Sep. 5, 2013 (Applicant—Columbia Insurance Co.//Inventor—Duncan et al.) (1 page).
Amendment and Response to Final Office Action filed on Dec. 16, 2014 with the U.S. Patent & Trademark Office for U.S. Appl. No. 13/411,195, filed Mar. 2, 2012, published as 2013-0230681 on Sep. 5, 2013 (Applicant—Columbia Insurance Co.//Inventor—Duncan et al.) (15 pages).
Non-Final Office Action issued on Jan. 14, 2015 by the U.S. Patent & Trademark Office for U.S. Appl. No. 13/411,195, filed Mar. 2, 2012, published as 2013-0230681 on Sep. 5, 2013 (Applicant—Columbia Insurance Co.//Inventor—Duncan et al.) (9 pages).
Preliminary Amendment filed Jun. 12, 2012 with the U.S. Patent & Trademark Office for U.S. Appl. No. 13/411,195, filed Mar. 2, 2012, published as 2013-0230681 on Sep. 5, 2013 (Applicant—Columbia Insurance Co.//Inventor—Duncan et al.) (2 pages).
Non-Final Office Action issued on Sep. 25, 2012 by the U.S. Patent & Trademark Office for U.S. Appl. No. 13/411,195, filed Mar. 2, 2012, published as 2013-0230681 on Sep. 5, 2013 (Applicant—Columbia Insurance Co.//Inventor—Duncan et al.) (9 pages).
Amendment in Response to Non-Final Office Action filed on Dec. 21, 2012 by the U.S. Patent & Trademark Office for U.S. Appl. No. 13/411,195, filed Mar. 2, 2012, published as 2013-0230681 on Sep. 5, 2013 (Applicant—Columbia Insurance Co.//Inventor—Duncan et al.) (18 pages).
Final Office Action issued on Feb. 14, 2013 by the U.S. Patent & Trademark Office for U.S. Appl. No. 13/411,195, filed Mar. 2, 2012, published as 2013-0230681 on Sep. 5, 2013 (Applicant—Columbia Insurance Co.//Inventor—Duncan et al.) (11 pages).

(56) References Cited

OTHER PUBLICATIONS

Amendment in Response to Final Office Action filed on May 14, 2013 with the U.S. Patent & Trademark Office for U.S. Appl. No. 13/411,195, filed Mar. 2, 2012, published as 2013-0230681 on Sep. 5, 2013 (Applicant—Columbia Insurance Co.//Inventor—Duncan et al.) (21 pages).
Non-Final Office Action issued on Jul. 23, 2014 by the U.S. Patent & Trademark Office for application 14/197,854, filed on Mar. 5, 2014 and published as US-2014-0260032-A1 on Sep. 18, 2014 (Applicant—Columbia Insurance Co. // Inventor—Managan, et al.) (11 pages).
Response to Non-Final Office Action filed on Dec. 19, 2014 for application 14/197,854, filed on Mar. 5, 2014 and published as US-2014-0260032-A1 on Sep. 18, 2014 (Applicant—Columbia Insurance Co. // Inventor—Managan, et al.) (7 pages).
Non-Final Office Action issued on Jan. 30, 2015 by the U.S. Patent & Trademark Office for application 14/197,854, filed on Mar. 5, 2014 and published as US-2014-0260032-A1 on Sep. 18, 2014 (Applicant—Columbia Insurance Co. // Inventor—Managan, et al.) (13 pages).
Response to Non-Final Office Action filed on Jul. 30, 2015 for application 14/197,854, filed on Mar. 5, 2014 and published as US-2014-0260032-A1 on Sep. 18, 2014 (Applicant—Columbia Insurance Co. // Inventor—Managan, et al.) (15 pages).
Final Office Action issued on Sep. 22, 2015 by the U.S. Patent & Trademark Office for U.S. Appl. No. 14/197,854, filed Mar. 5, 2014 and published as US-2014-0260032-A1 on Sep. 18, 2014 (Applicant—Columbia Insurance Co. // Inventor—Managan, et al.) (26 pages).
Amendment and Response to Final Office Action filed on Dec. 22, 2015 for U.S. Appl. No. 14/197,854, filed Mar. 5, 2014 and published as US-2014-0260032-A1 on Sep. 18, 2014 (Applicant—Columbia Insurance Co. // Inventor—Managan, et al.) (14 pages).
Notice of Allowance issued on Jan. 14, 2016 by the U.S. Patent & Trademark Office for U.S. Appl. No. 14/197,854, filed Mar. 5, 2014 and published as US-2014-0260032-A1 on Sep. 18, 2014 (Applicant—Columbia Insurance Co. // Inventor—Managan, et al.) (11 pages).
Amendment and Response to Non-Final Office Action filed on May 22, 2015 for U.S. Appl. No. 13/411,195, filed Mar. 2, 2012, published as 2013-0230681 on Sep. 5, 2013 (Applicant—Columbia Insurance Co.//Inventor—Duncan et al.) (14 pages).
Final Office Action issued on Aug. 11, 2015 by the U.S. Patent & Trademark Office for U.S. Appl. No. 13/411,195, filed Mar. 2, 2012, published as 2013-0230681 on Sep. 5, 2013 (Applicant—Columbia Insurance Co.//Inventor—Duncan et al.) (13 pages).
Response to Final Office Action filed on Nov. 11, 2015 for U.S. Appl. No. 13/411,195, filed Mar. 2, 2012, published as 2013-0230681 on Sep. 5, 2013 (Applicant—Columbia Insurance Co.// Inventor—Duncan et al.) (11 pages).
Non-Final Office Action issued on Jan. 12, 2016 by the U.S. Patent & Trademark Office for U.S. Appl. No. 13/411,195, filed Mar. 2, 2012, published as 2013-0230681 on Sep. 5, 2013 (Applicant—Columbia Insurance Co.//Inventor—Duncan et al.) (13 pages).
Amendment and Response to Non-Final Office Action filed on Feb. 19, 2016 for U.S. Appl. No. 13/411,195, filed Mar. 2, 2012, published as 2013-0230681 on Sep. 5, 2013 (Applicant—Columbia Insurance Co.//Inventor—Duncan et al.) (10 pages).
Final Office Action issued on May 13, 2016 by the U.S. Patent & Trademark Office for U.S. Appl. No. 13/411,195, filed Mar. 2, 2012, published as 2013-0230681 on Sep. 5, 2013 (Applicant—Columbia Insurance Co.//Inventor—Duncan et al.) (10 pages).
Amendment and Response to Non-Final Office Action filed on Sep. 21, 2015 for for U.S. Appl. No. 13/526,155, filed Jun. 18, 2012, published as 2013-0230682 on Sep. 5, 2013 (Applicant—Columbia Insurance Co.//Inventor—Duncan et al.) (16 pages).
Final Office Action issued on Sep. 30, 2015 for U.S. Appl. No. 13/526,155, filed Jun. 18, 2012, published as 2013-0230682 on Sep. 5, 2013 (Applicant—Columbia Insurance Co.//Inventor—Duncan et al.) (14 pages).
Second Examination Report issued on Nov. 13, 2015 by the Australian Patent Office for application 2013201200 filed Mar. 1, 2013 (Applicant—Shaw Industries Group, Inc.//Inventor—Duncan et al.) (3 pages).

* cited by examiner

PATTERNED TILES AND FLOOR COVERINGS COMPRISING SAME

CROSS-REFERENCE TO RELATED APPLICATION

This application is a continuation of U.S. patent application Ser. No. 14/197,854, filed Mar. 5, 2014, which claims the benefit of U.S. Provisional Application No. 61/779,585, filed Mar. 13, 2013. These applications are hereby incorporated herein by reference in their entirety.

BACKGROUND

The invention relates in general to patterned tile. More particularly, the invention relates to patterned tiles that cooperatively define a floor covering in which a contrast pattern of a given tile achieves a desired visual appearance relative to contrast patterns of adjacent tiles.

FIELD

Conventional carpet tile has historically been a product that sought to mimic the appearance of broadloom carpet and to hide or at least de-emphasize the fact that the product was modular. Carpet tile and other textile face modular flooring conventionally has been highly uniform in size, shape, and appearance and has had edge and corner structures that present a uniform floor covering when edges of adjacent tiles are abutting. Similarly, the tiles of resilient floor coverings have typically had a uniform size, shape, and appearance, with edge and corner structures that present a uniform floor covering when edges of adjacent tiles are abutting.

Some more recent carpet tile designs and patterns have provided carpet tiles that can be positioned at any rotational position relative to adjacent tiles without disrupting the overall pattern of the floor covering. Thus, for these floor coverings, regardless of the rotational position of each respective tile, the same overall visual effect is achieved.

There is a need for modular floor designs that are not restricted to a single, consistent overall appearance. Consequently, there remains a need for modular flooring tiles that cooperate to produce distinct visual effects within a floor covering, thereby varying the overall appearance and visual effect of the floor covering depending upon the particular rotational positions of the tile.

SUMMARY

The present invention is generally directed to tiles having first and second end edges and first and second side edges. The distance between the first and second side edges of each tile correspond to a width of the tile. Each tile includes a first portion having a background pattern of at least one color. Each tile further includes a second portion having a contrast pattern intermixed with a portion of the background pattern. The contrast pattern has at least one contrast color that is different from the colors of the background pattern. The first portion of the tile is divided from the second portion by a diagonal boundary line extending across the width of the tile from a first position on the first side edge of the tile to a second position on the second side edge of the tile. The first position on the first side edge can be spaced from the first end edge by a first distance, and the second position on the second side edge can be spaced from the second end edge by a second distance. The first distance can be substantially equal to the second distance. The contrast pattern of each tile can be configured to emphasize the location of a selected corner of the tile. Hard surface coverings, such as floor coverings, including the tiles described herein are also disclosed.

One skilled in the art will appreciate that tile-forming cuts cannot easily be positioned with precision relative to features on the face of a floor covering web. However, as a practical matter, it can be predicted (in the sense that it is reasonably possible to ensure) that the cuts in a floor covering web, and therefore selected corner edges produced by such cuts, will fall within predetermined longitudinal and cross-web bands or regions of the formed web. By utilizing these bands or regions to define what will become "design" or "contrast" tile areas (which have the more prominent design elements), and by producing webs with relatively uniform appearance in the bands or regions outside the "design" or "contrast" tile areas, it is possible to produce attractive tiles with prominent, generally corner-oriented design elements and to produce visually attractive installations of such tiles that differ significantly in appearance from prior tile installations. In one aspect, while such installations can have visually prominent modularity in that there is a one-to-one correspondence between visually prominent design elements and the tiles, the appearance of the installation can mimic a broadloom carpet, area rug, or other conventional resilient floor covering having relatively large scale. Such an attractive installation is particularly possible utilizing, together with the tiles of this invention, "plain" tiles, the entire surfaces of which are a background design such as the design that appears as a background pattern within tiles having other design elements as described herein. However, it is contemplated that the patterns and arrangements disclosed herein can also be applied to non-flooring tiles, such as, for example and without limitation, wall tiles and ceiling tiles.

Because the "design" or "contrast" tile areas are positioned at and extend inwardly relative to a corner of the tile, it is contemplated that cuts on similar tiles do not necessarily have to be formed in the same way; thus, it is contemplated that the "design" or "contrast" tile areas on the respective tiles can vary from tile to tile. In some aspects, at least some of the design elements area on otherwise like tiles can vary, and in an installation of such tiles some tiles might appear to have misplaced design tile areas. It is contemplated that an assembly of such tiles with design" or "contrast" tile areas positioned at and extending inwardly from a corner of the tile can appear to a viewer to be intentional and attractive. In some aspects, such intentional, attractive variation of tile appearance can also be achieved by using design elements having different sizes, shapes or other features of appearance within the "design" or "contrast" tile areas as well as differing off-corner positioning.

BRIEF DESCRIPTION OF THE DRAWINGS

The accompanying drawings, which are incorporated in and constitute a part of this specification, illustrate several aspects described below and together with the description, serve to explain the principles of the invention. Like numbers represent the same elements throughout the figures. The patent or application file contains at least one drawing executed in color.

Figure 1A:
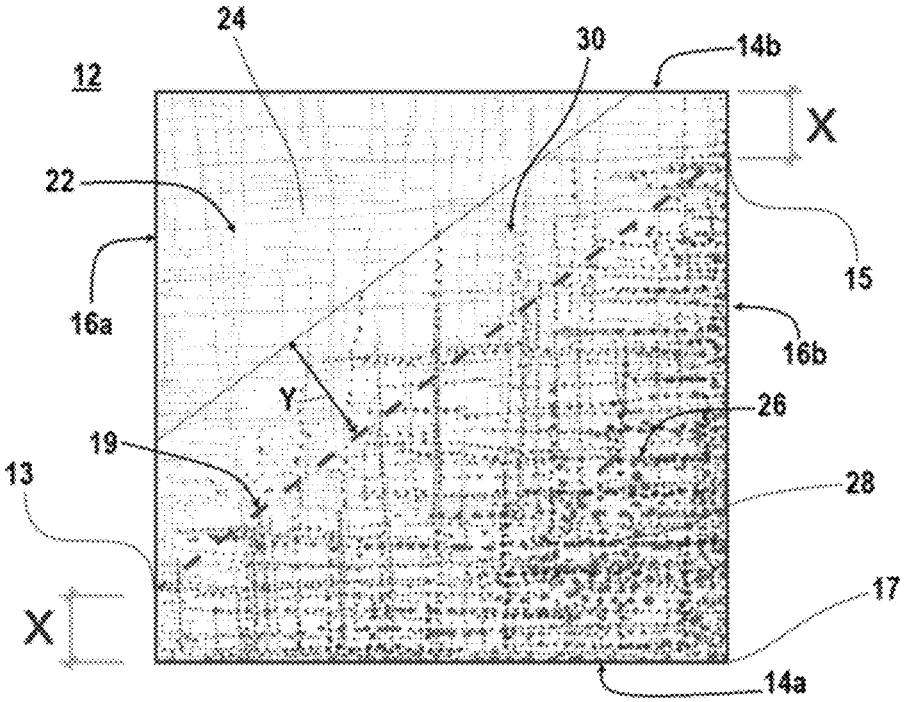
FIG. 1A displays a top view of an exemplary tile as described herein.

As shown throughout the Figures, the letter "R" is intended to provide an indication of the orientation of one tile relative to adjacent tiles.

DETAILED DESCRIPTION

The present invention can be understood more readily by reference to the following detailed description, examples, drawing, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a contrast pattern" can include two or more such contrast patterns unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

As used herein, the term "tile" refers to any conventional modular tile, including, for example and without limitation, resilient and/or vinyl flooring tiles, carpet flooring tiles, ceramic flooring tiles, ceramic wall tiles, and ceiling tiles.

As used throughout, the term "carpet tile" refers to carpet tiles and other conventional textile-face modular flooring tiles.

As used herein, the definition of the term "color" is referenced in terms of the CIELAB color scale, which was created by the International Commission on Illumination (CIE). The CIELAB color scale provides a uniform scale for measuring and comparing the color values of different samples. Three different color measurements are used to determine the CIELAB color value of a given sample: 1) a white-black color measurement; 2) a red-green color measurement; and 3) a yellow-blue color measurement. The white-black color measurement represents the amount of white present in the sample relative to the amount of black present in the sample. The red-green color measurement represents the amount of red present in the sample relative to the amount of green present in the sample. The yellow-blue color measurement represents the amount of yellow present in the sample relative to the amount of blue present in the sample. CIELAB color scale values can be obtained using color measurement instruments known in the art, including, for example, HunterLab color measurement instruments.

As used herein, the term "surface covering" refers to any hard surface tile covering, including, for example and without limitation, floor coverings, wall coverings, and ceiling coverings.

As used throughout, the terms "tuft", "tufting", "tufted", "tufted-in", and other verb tenses thereof refer to inserting, pressing, passing, and/or any other conventional process by which yarn is attached or otherwise coupled to the carpet backing.

In one aspect, and as shown in FIGS. 3A-9B, a methodology is provided for forming a surface covering 10. The surface covering 10 can be formed from a plurality of tiles 12 as further described herein. In exemplary aspects, the plurality of tiles 12 can be configured for selective positioning relative to one another to thereby produce a desired visual appearance. It is contemplated that the surface covering can be a floor covering, a wall covering, a ceiling covering, or any other conventional hard surface covering.

Figure 1B:
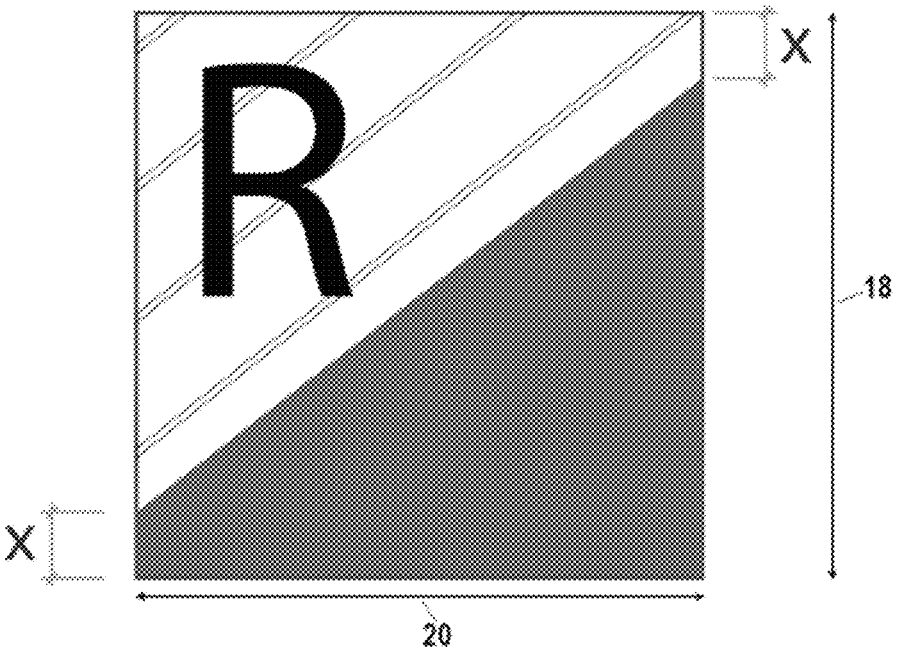
FIG. 1B displays a corresponding template design.
Figure 2:
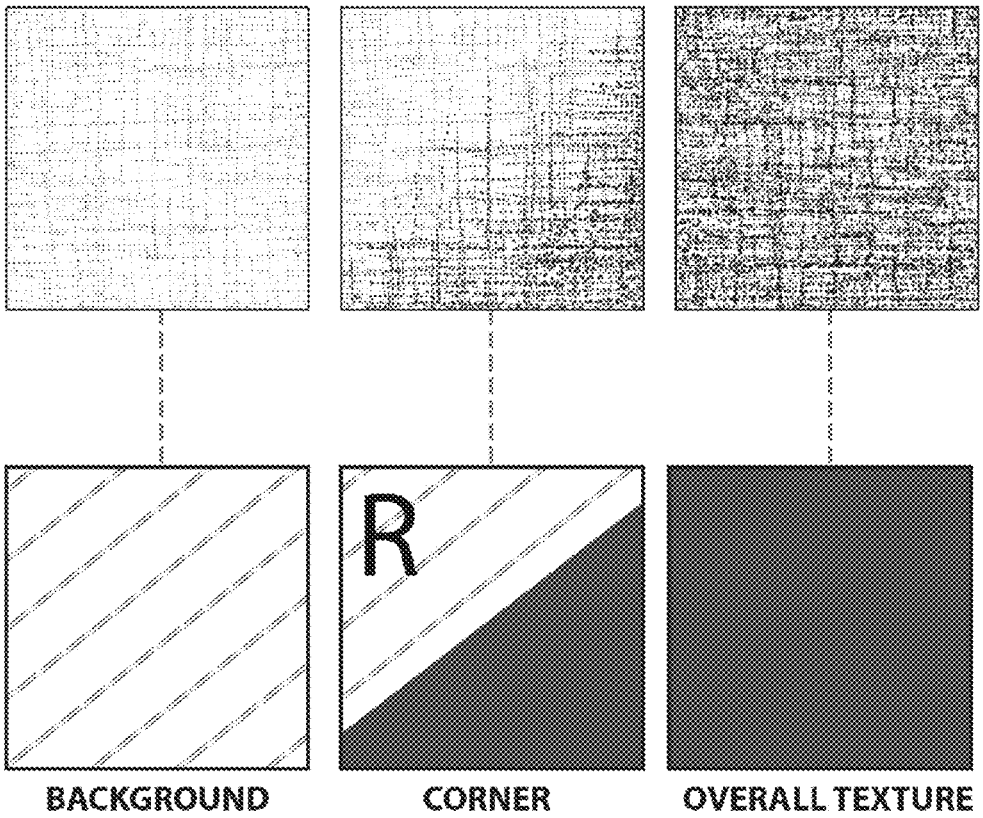
FIG. 2 is a top view of an exemplary corner-oriented tile as described herein, shown together with exemplary background and contrast (texture) tiles.
Figure 3A:
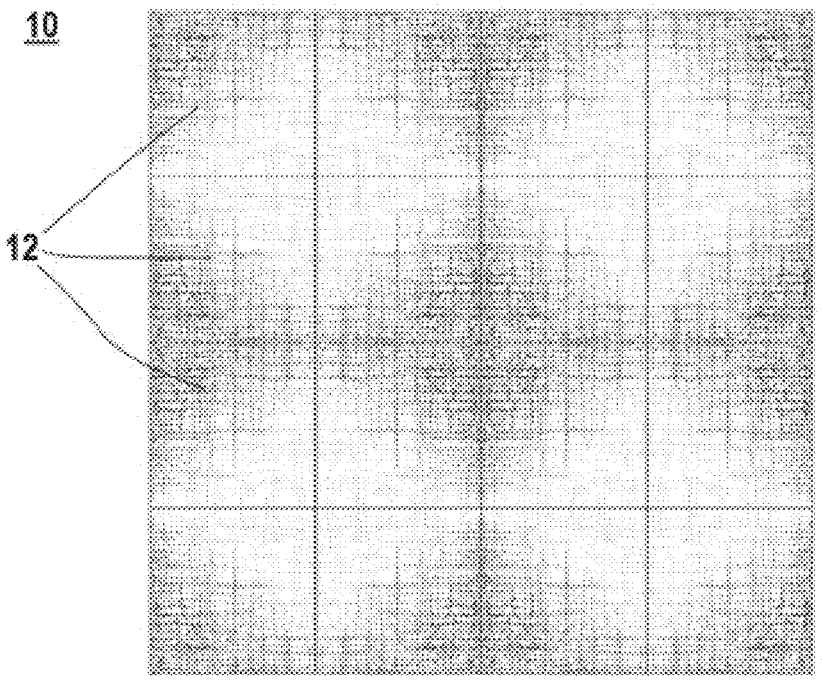
FIGS. 3A, 4A, 5A, 6A, 7A, 8A and 9A provide top views of exemplary surface coverings formed using tiles as described herein.
Figure 3B:
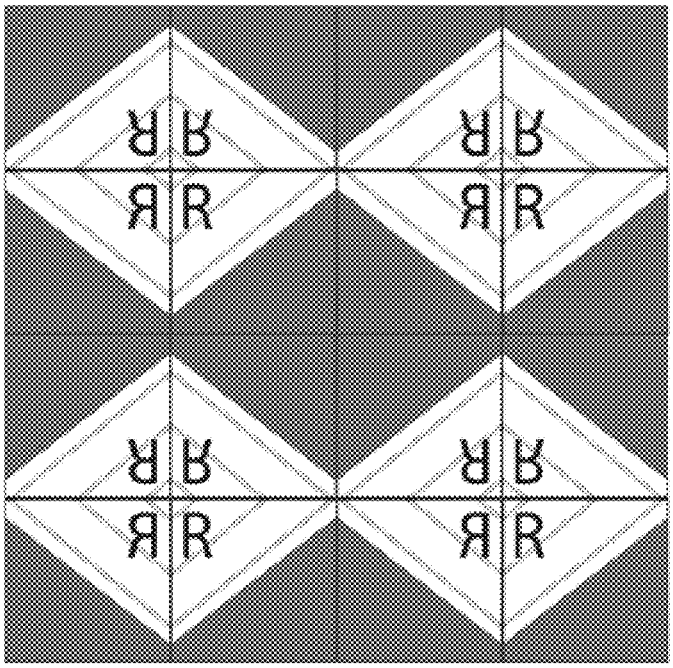
FIGS. 3B, 4B, 5B, 6B, 7B, 8B and 9B provide corresponding floor covering templates showing the relative orientation of each respective tile of the floor covering.
Figure 4A:
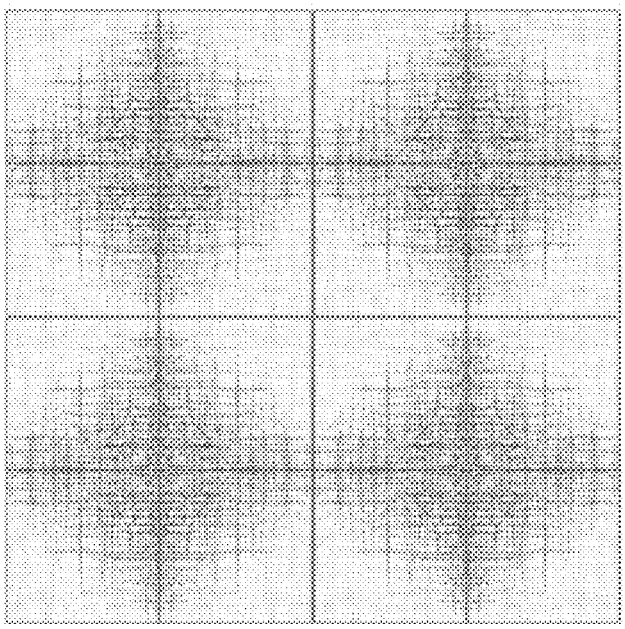
Figure 4B:
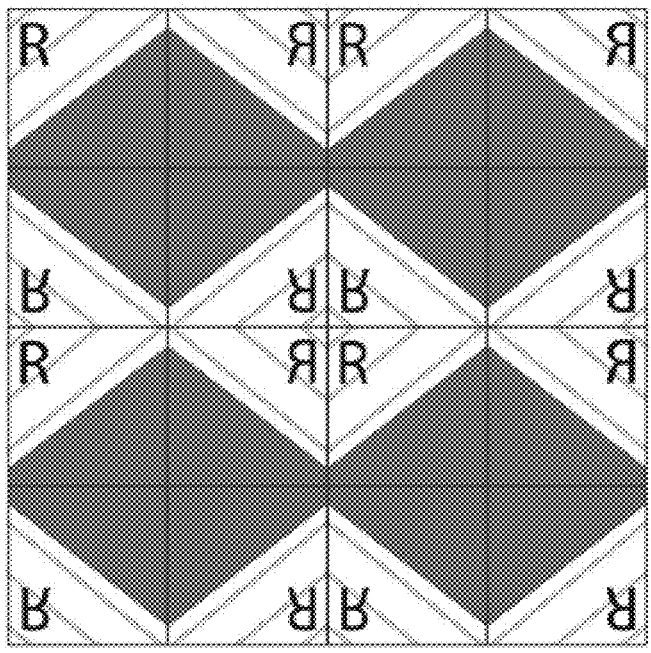
Figure 5A:
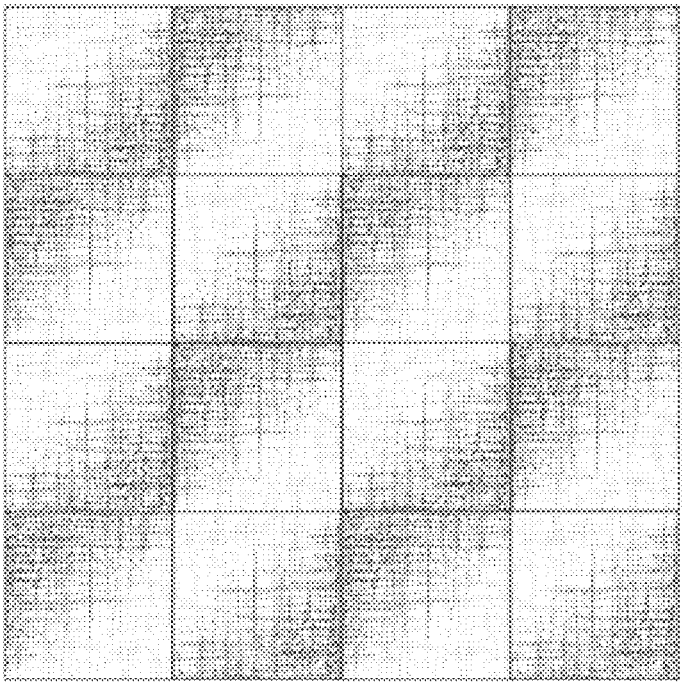
Figure 5B:
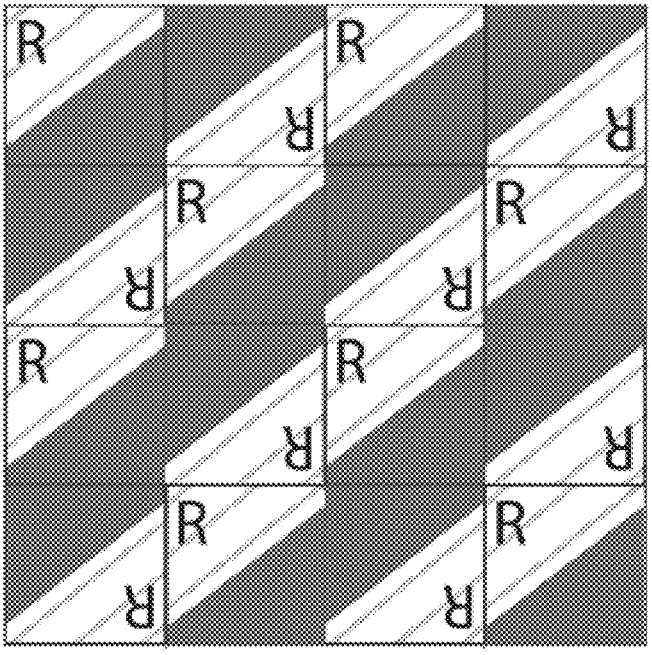
Figure 6A:
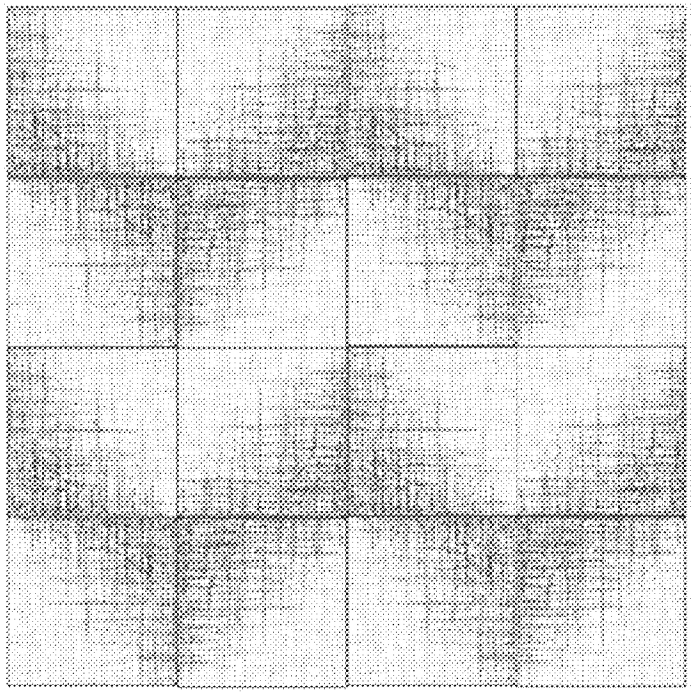
Figure 6B:
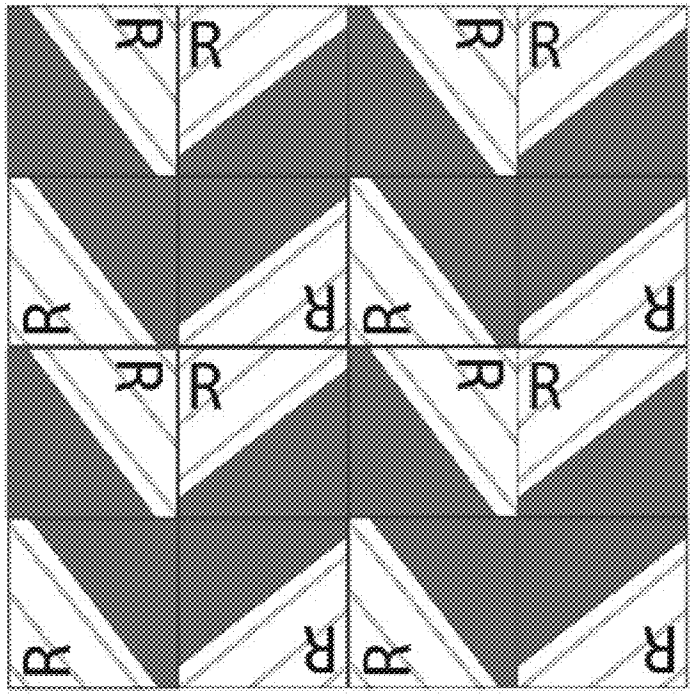
Figure 7A:
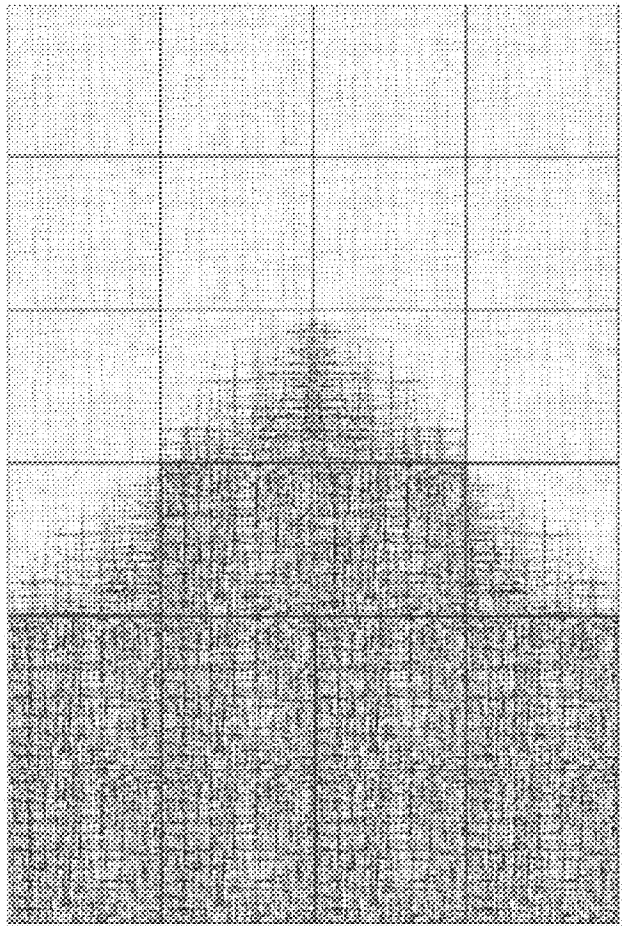
Figure 7B:
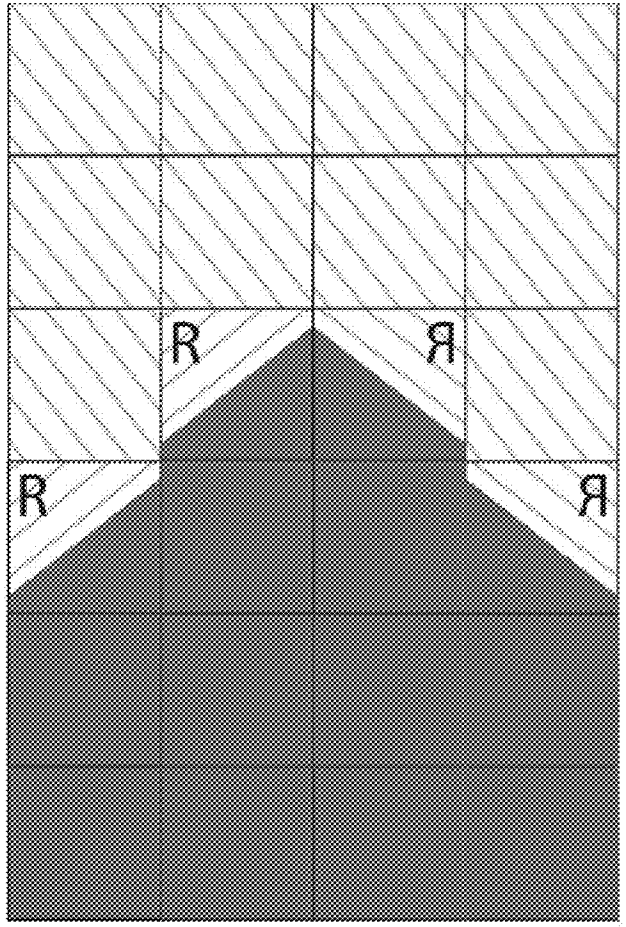
Figure 8A:
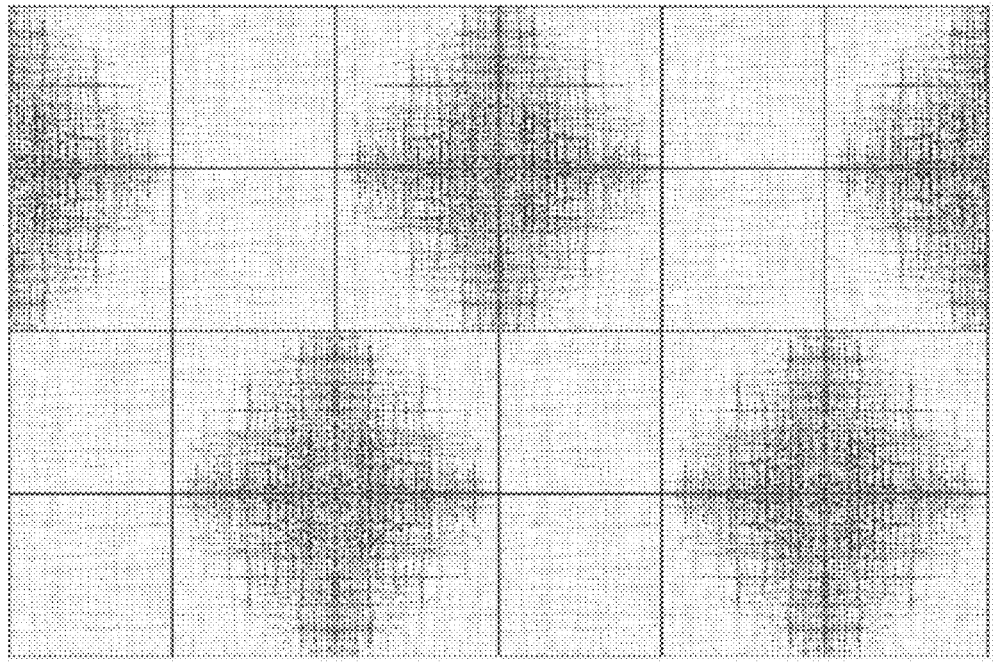
Figure 8B:
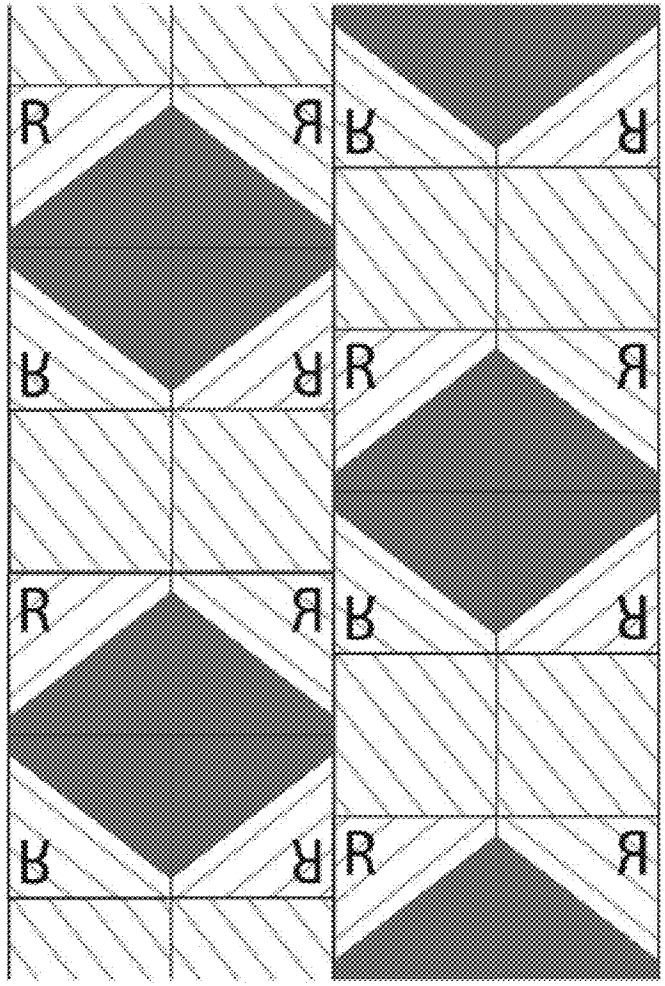

In one aspect, and as shown in FIGS. 1A and 1B, a tile 12 is provided having first and second end edges 14*a*, 14*b* and first and second side edges 16*a*, 16*b*. In this aspect, it is contemplated that the distance between the first and second end edges 14*a*, 14*b* of the tile 12 can correspond to a length 18 of the tile. It is further contemplated that the distance between the first and second side edges 16*a*, 16*b* of the tile 12 can correspond to a width 20 of the tile.

In exemplary aspects, the tile 12 can be substantially square (having a length 18 and a width 20 that are substantially equal). It is also contemplated that the tile 12 can be substantially rectangular (having a length 18 and a width 20 that are substantially different). Thus, it is contemplated that the tile 12 can have four spaced corners. However, it is contemplated that the tile 12 can have any desired shape, including a desired conventional shape or a desired irregular and/or organic shape.

For square and rectangular tiles 12 as described herein, it is understood that the respective side edges (16*a*, 16*b*) and end edges (14*a*, 14*b*) can be determined depending on the particular orientation of the tile. Thus, for any given tile 12, there are four potential orientations. For example, in one orientation of a tile, a particular edge of the tile may function as a side edge, whereas in another orientation of a tile, the same edge may function as an end edge. Therefore, although the tiles 12 are described herein with respect to particular side or end edges, such description is meant to refer to only one possible orientation of the tile, and it is understood that the tiles are not limited to a particular orientation. For example, the tile shown in FIG. 1A can be rotated 90 degrees or 270 degrees (as shown in the Figure) to orient the side and end edges in a manner consistent with the description herein.

In exemplary aspects, it is contemplated that the tile 12 can be a vinyl tile. In these aspects, it is contemplated that the tile 12 can have a face that is printed using conventional methods.

In further exemplary aspects, it is contemplated that the tile 12 can be a carpet tile. In these aspects, it is contemplated that the tile 12 can have a tufted face, a woven face, or a fusion-bonded face that is formed according to conventional methods. It is further contemplated that at least a portion of the face of the carpet tile 12 can be printed using conventional methods.

In still further exemplary aspects, it is contemplated that the tile 12 can be a ceramic tile that is formed using conventional methods. In these aspects, it is contemplated that the tile 12 can be any ceramic tile, including, for example and without limitation, ceramic flooring tiles, ceramic wall tiles, ceramic ceiling tiles, and the like. In still further exemplary aspects, it is contemplated that the tile 12 can be a wall tile that is formed using conventional methods. In still further exemplary aspects, it is contemplated that the tile 12 can be a ceiling tile that is formed using conventional methods. However, it is contemplated that the tile can be any known flooring tile, wall tile, ceiling tile, or other tile that is conventionally used as a surface covering.

In another aspect, the tile 12 can comprise a first portion 22 having a background pattern 24 comprising at least one color. In this aspect, the at least one color of the background pattern 24 of the tile 12 can comprise a majority color and a minority color. In exemplary aspects, the first portion 22 of the tile 12 can extend the entire width 20 of the tile.

In an additional aspect, the tile 12 can further comprise a second portion 26 having a contrast pattern 28 intermixed with a portion of the background pattern 24. In this aspect, the contrast pattern 28 can comprise at least one contrast color that is different than the at least one color of the background pattern 24. In exemplary aspects, it is contemplated that the second portion 26 of the tile can comprise a plurality of contrast patterns rather than a single contrast pattern 28.

In various exemplary aspects, as shown in FIGS. 1A and 1B, the tile 12 can have a boundary line 19 extending diagonally across the width 20 of the tile from a first position 13 on the first side edge 16*a* of the tile to a second position 15 on the second side edge 16*b* of the tile. As used herein, it is understood that the "boundary line" is not visibly defined on the face of the tile 12; rather, the boundary line 19 can be visibly inferred from the diagonal orientation of the contrast pattern 28 of the second portion 26 of the tile. In these aspects, the boundary line 19 substantially divides the first portion 22 of the tile 12 from the second portion 26 of the tile. It is understood that the boundary line 19 does not extend from two opposing corners of the tile such that the tile is bisected into two equivalent triangles. Similarly, it is understood that the diagonal line 19 does not extend horizontally across the tile from a midpoint on the first side edge 16*a* of the tile to a midpoint on the second side edge 16*b* of the tile such that the tile is bisected into two equivalent rectangles. Rather, it is contemplated that the first position 13 on the first side edge 16*a* can be spaced from the first end edge 14*a* by a first distance, and the second position 15 on the second side edge 16*b* can be spaced from the second end edge 14*b* by a second distance, with the first distance being substantially equal to the second distance. As depicted in FIGS. 1A and 1B, both distances are indicated as "X." Thus, in exemplary aspects, it is contemplated that the boundary line 19 of the tile 12 can extend substantially diagonally across the width 20 of the tile to divide the tile into two distinct 4-sided (e.g., trapezoidal) wedge zones. In these aspects, the distinct wedge zones can be substantially equally offset from opposed parallel side edges of the tile. A first wedge zone (corresponding to first portion 22) can have a background pattern, while the second wedge zone (corresponding to second portion 26) can be filled with a concentration or density of patterns to create a distinct visual division between the two wedge zones. In further aspects, the area of the first portion 22 of the tile 12 can be substantially equal to the area of the second portion 26 of the tile.

In exemplary aspects, as shown in FIGS. 1A and 1B, the second portion 26 can be positioned proximate a selected corner 17 of the tile 12. In these aspects, the contrast pattern 28 can be configured to emphasize the location of the selected corner 17. It is contemplated that at least a portion of the contrast pattern 28 can be spaced from the selected corner 17. Alternatively, it is contemplated that at least a portion of the contrast pattern 28 can extend to the selected corner 17. In exemplary aspects, it is contemplated that at least a portion of the contrast pattern 28 can extend to the first side edge 16*a*, the second side edge 16*b*, and the first end edge 14*a*. It is further contemplated that, in exemplary aspects, the majority of the contrast pattern 28 can be positioned proximate the selected corner 17. In this aspect, the contrast pattern 28 can comprise the minority color of the background pattern 24 and at least one contrast color that is different from the majority color and the minority color of the background pattern. When the tile 12 is a carpet tile, it is understood that a difference between a first color and a second color as described herein can exist even though the first color is achieved by one or more yarns that are also used to achieve the second color, provided the first color and the second color, as visually perceived by an observer, are visibly different. In an additional aspect, as shown in FIGS. 1A-9B, it is contemplated that the contrast pattern can comprise an abstract pattern, such as, for example and without limitation, a speckled pattern. However, it is contemplated that the contrast pattern can comprise any combination of colors and/or shapes that achieve a desired visual appearance when positioned in a selected location within a floor covering. In one exemplary aspect, the contrast pattern 28 can be randomized (i.e., generated randomly). In another exemplary aspect, it is contemplated that the contrast pattern 28 can be printed on the tile 12 using conventional methods.

In additional exemplary aspects, the first portion 22 of the tile 12 can comprise a boundary zone 30. In these aspects, the boundary zone 30 can correspond to the portion of the first portion 22 that is positioned within a predetermined distance Y of the boundary line 19 (measured perpendicularly to the boundary line). It is contemplated that a portion of the contrast pattern 28 can extend from the second portion 26 into the boundary zone 30. It is further contemplated that the ratio between the length 18 of the tile 12 and the predetermined distance Y can range from about 2:1 to about 20:1 and, more preferably, be about 3:1. It is still further contemplated that the ratio between the width 20 of the tile 12 and the predetermined distance Y can range from about 2:1 to about 20:1 and, more preferably, be about 3:1.

In other aspects, it is contemplated that the ratio between the length 18 of the tile 12 and the first distance (between the first position 13 and the first end edge 14*a*) and the ratio between the length of the tile and the second distance (between the second position 15 and the second end edge 14*b*) can both range from about 1.2:1 to about 10:1. Similarly, it is contemplated that the ratio between the width 20 of the tile 12 and the first distance (between the first position 13 and the first end edge 14*a*) and the ratio between the width of the tile and the second distance (between the second position 15 and the second end edge 14*b*) can both range from about 1.2:1 to about 10:1. Thus, it is contemplated that, in some aspects, the shape of the second portion 26 of the tile 12 can be substantially inverted relative to the shape of the second portion depicted in FIGS. 1A and 1B. In these aspects, it is contemplated that the first distance (by which the first position 13 is spaced from the first end edge 14*a*) and the second distance (by which the second position 15 is spaced from the second end edge 14*b*) can correspond to a majority of the length 18 of the tile 12. Optionally, in one exemplary aspect, the ratio between the length 18 of the tile 12 and the first distance (between the first position 13 and the first end edge 14*a*) and the ratio between the length of the tile and the second distance (between the second position 15 and the second end edge 14*b*) can both range from about 4:1 to about 8:1. Optionally, in another exemplary aspect, the ratio between the length 18 of the tile 12 and the first distance (between the first position 13 and the first end edge 14*a*) and the ratio between the length of the tile and the second distance (between the second position 15 and the second end edge 14*b*) can both range from about 1.2:1 to about 1.8:1.

In one aspect, it is contemplated that the background pattern 24 and the contrast pattern 28 can each be formed using conventional printing methods. In another aspect, when the tile 12 is a carpet tile, it is contemplated that the background pattern 24 and the contrast pattern 28 can each be formed from a plurality of yarn tufts using conventional tufting methods. In this aspect, within the contrast pattern 28, at least some of the yarn tufts of the at least one contrast color can have a height that is greater than a height of at least some of the yarn tufts of the minority color proximate the yarn tufts of the at least one contrast color. It is further contemplated that, within the contrast pattern, at least some of the yarn tufts of the at least one contrast color can have a height that is substantially equal to the height of at least some of the yarn tufts of the minority color proximate the yarn tufts of the at least one contrast color. It is still further contemplated that, within the contrast pattern, at least some of the yarn tufts of the at least one contrast color can have a height that is less than the height of at least some of the yarn tufts of the minority color proximate the yarn tufts of the at least one contrast color.

In various optional aspects, and referring the FIGS. 1A-9B, it is contemplated that the tile 12 can be designed and manufactured with design elements located in any portion of the "contrast" or "texture" tile areas, i.e., the second portion 26. As one will appreciate, the exact dimensions of the second portion 26 of the tile, as well as the location of the boundary line 19 of the tile can vary between otherwise like tiles. Thus, the design of the tiles allows for variations in the cutting out of the respective tiles without causing violence, however, to the appearance of tile 12, in part because the second portion or optionally the contrast pattern or design elements within the second portion 26 are not necessarily required to be positioned identically in otherwise like tiles 12. In effect, it is contemplated that the slight differences between otherwise like tiles would be celebrated in the assembly of the tiles 12.

In an additional aspect, it is contemplated that the second portion 26 of the tile and/or the contrast pattern 28 or design elements within the second portion 26 of the carpet tile 12 can be produced by any technique causing a visually perceptible result on the face of the respective tile 12. In the case of carpet tiles, such techniques include techniques altering tuft height and appearance, and including yarn color. In one aspect, the selected contrast pattern 28 or design element can be any desired shape or collection of shapes or yarn and/or surface appearances. Certainly, it is contemplated that some of the benefits of this invention will be enjoyed only if at least some of the contrast pattern 28 or design elements in an installation of tiles are intentionally positioned to emphasize the location of a selected corner of the second portion of the tile.

As described in more detail below, it is contemplated that a large number of different arrangements of the relative positions of a particular group of tiles is possible when installing tiles on a floor, wall, ceiling, or other surface. The design of the distinctive tiles described herein make it possible, indeed, make it easy to create assemblies of tiles of this invention that differ from each other, while achieving the same general appearance if desired. It is also contemplated that additional variations in the appearance of tile installations can be achieved by incorporating into the installation different tiles, such as tiles having only the "background" pattern or color or visual appearance of the first portion 22, tiles having only the "contrast" or "texture" pattern of the second portion 26, or entirely different tiles carrying an entirely different pattern or color or both.

As should also be apparent from the description above and below and examination of the Figures, the details of the design of the tile 12 utilized in these examples are merely exemplary and can be substantially altered without departing from the scope and spirit of this invention. Among other variations possible, the relative area of the face of the second portion 24 with respect the face area of the tile 12 can be changed, the appearance of the design elements or contrast patterns positioned within the second portion 24 of the tile 12 can be altered, and the appearance of the background or first portion 22 of the tile can be changed.

In one exemplary aspect, the tiles 12 described herein can be resilient tiles. In this aspect, it is contemplated that the tiles 12 can be formed from any conventional resilient tile surface, including, for example and without limitation, sheet vinyl, vinyl composition tile (VCT) materials, linoleum, cork, rubber, and the like.

In another exemplary aspect, the tiles 12 described herein can be carpet tiles formed using conventional type 6 nylon, type 6.6 nylon, polypropylene, polyester, and the like, and the appearance differences in the carpet tiles can be achieved by varying the treadup, color or the height and other properties of the formed tufts or stitches on the carpet tiles. It is also contemplated that different types and/or colors of yarns could also be used, and pattern elements and field or background portion appearances can be achieved utilizing a very wide variety of different conventional and not-yet-developed carpet, fabric and flooring production techniques.

Figure 9A:
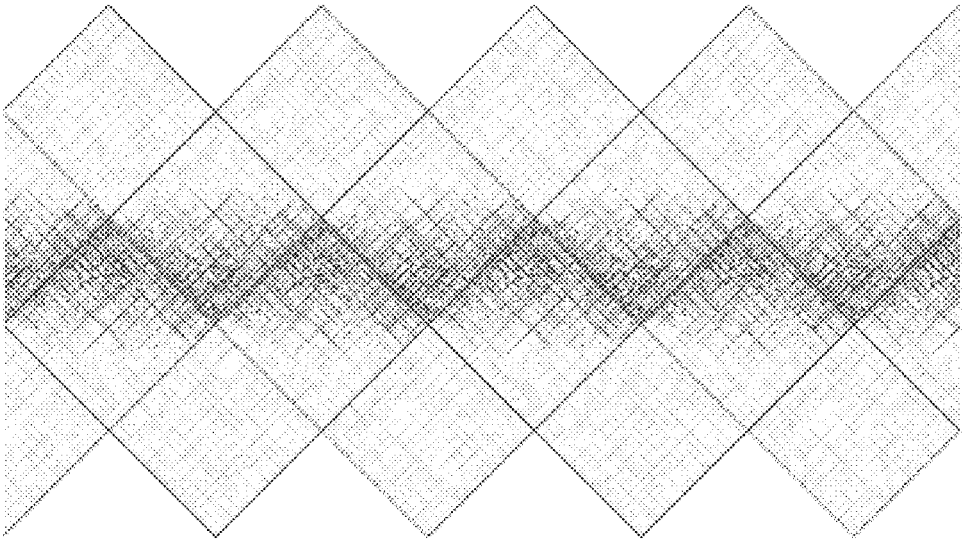
Figure 9B:
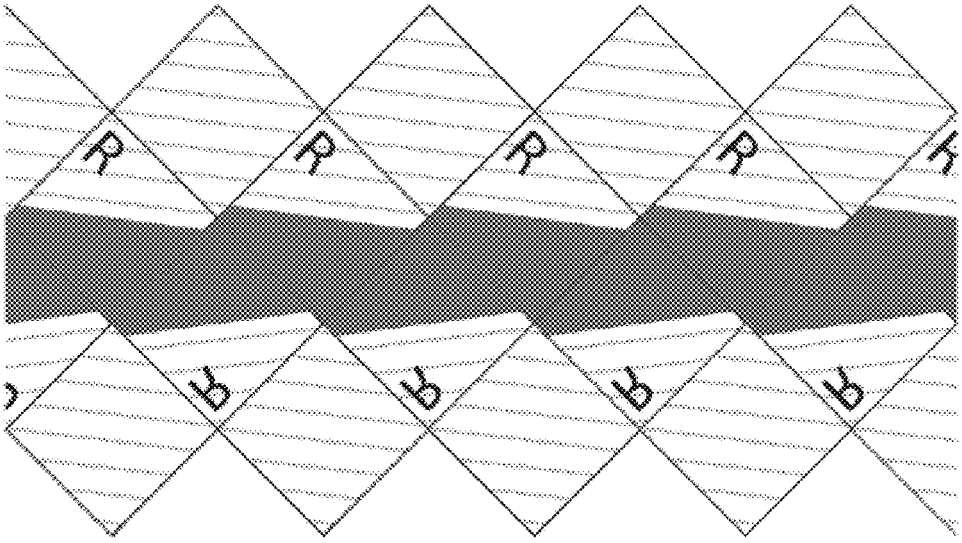
Figure 10A:
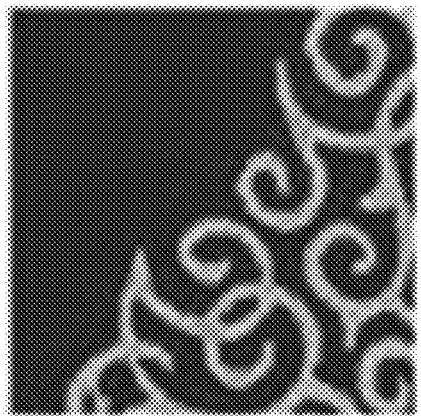
FIGS. 10A, 10B and 10C display multiple orientations of an exemplary corner-oriented tile as described herein.
Figure 10B:
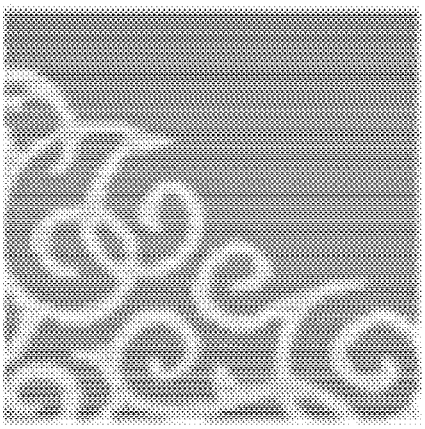
Figure 10C:
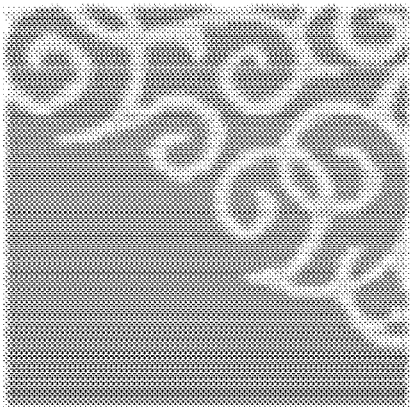

It is contemplated that a plurality of the tiles 12, a tile assembly, can be positioned on a selected surface (e.g., a flooring surface, a wall, or a ceiling) to thereby cooperatively define a surface covering 10. In an exemplary aspect, the plurality of tiles 12 can be configured for selective positioning relative to one another such that the contrast pattern 28 of each tile has a desired visual appearance relative to the contrast patterns of adjacent tiles. In this aspect, it is contemplated that the contrast patterns 28 of adjacent tiles can cooperate to produce a desired visual effect proximate one or more selected corners 17 of the adjacent tiles. In another exemplary aspect, as shown in FIGS. 3A, 3B, 4A, 4B, 6A, and 6B, the plurality of tiles 12 can be configured for selective positioning relative to one another such that the selected corner of a first tile abuts the selected corner of a second tile and at least a portion of the contrast pattern of the first tile is positioned adjacent the contrast pattern of the second tile. In still another exemplary aspect, as shown in FIGS. 5A-6B, the plurality of tiles can be configured for selective positioning relative to one another such that the selected corner of a first tile is spaced apart from the selected corner of a second, adjacent tile and the contrast pattern of the first tile is spaced apart from the contrast pattern of the second tile. In yet another exemplary aspect, as shown in FIGS. 3A-6B, the plurality of tiles can be configured for selective positioning relative to one another such that at least a portion of the first portion of a first tile abuts at least a portion of the first portion of an adjacent tile. In still another exemplary aspect, as shown in FIGS. 3A-8B, the tiles 12 of the surface covering 10 can be positioned in substantial alignment with adjacent tiles of the surface covering such that the corresponding edges of the tiles are axially aligned. Alternatively, in a further exemplary aspect, as shown in FIGS. 9A and 9B, it is contemplated that at least one tile 12 of the surface covering 10 can be offset from at least one adjacent tile of the surface covering such that the corresponding edges of the tiles are offset from one another.

An exemplary method for forming a surface covering as described herein can comprise providing a plurality of tiles as described herein. The method can further comprise positioning the plurality of tiles relative to one another on a hard surface such that the contrast pattern of each tile has a desired visual appearance relative to the contrast patterns of adjacent tiles. In an exemplary aspect, the method for forming the surface covering can comprise selectively positioning the plurality of tiles relative to one another such that the selected corner of a first tile abuts the selected corner of a second tile and at least a portion of the contrast pattern of the first tile is positioned adjacent the contrast pattern of the second tile. In another exemplary aspect, the method for forming the surface covering can comprise selectively positioning the plurality of tiles relative to one another such that the selected corner of a first tile is spaced apart from the selected corner of a second, adjacent carpet tile and the contrast pattern of the first tile is spaced apart from the contrast pattern of the second tile.

In some aspects, when the plurality of tiles are square tiles, it is contemplated that the plurality of tiles can be positioned relative to one another to achieve conventional "monolithic," "¼ turn," "Ashlar," "brick," "random," and "interactive" surface covering configurations. In additional aspects, when the plurality of tiles are rectangular tiles, it is contemplated that the plurality of tiles can be positioned relative to one another to achieve conventional "monolithic," "brick," "boxed in," "basketweave," half basketweave," and "herringbone" surface covering configurations. It is further contemplated that, within these conventional surface covering configurations, each tile of the plurality of tiles can be selectively rotated such that the contrast patterns of adjacent tiles achieve the desired visual appearance.

It is contemplated that the selected position of each tile of the plurality of tiles can be determined based purely upon the appearance of the face of the tile, particularly the appearance of the contrast pattern proximate the selected corner of the tile. It is further contemplated that the selected position of each tile within a floor covering can be determined entirely without reference to arrows imprinted on the back side of the tiles, as is conventionally done in the art. Thus, it is still further contemplated that the disclosed tiles can permit customized, non-conventional surface covering designs that are achieved through a particular, selected arrangement of tiles in which the contrast portions of adjacent tiles cooperate to achieve the desired visual appearance. Exemplary non-conventional surface covering configurations and their corresponding installation keys are provided in FIGS. 3A-9B.

In particular exemplary aspects, such as shown in FIGS. 7A-9B, it is contemplated that the tiles disclosed herein can be incorporated into surface coverings comprising one or more conventional tiles, such as, for example and without limitation, tiles having a uniform face pattern. In these aspects, it is contemplated that the conventional tiles can cooperate with the contrast patterns of adjacent tiles to achieve the desired visual appearance. In exemplary aspects, one or more of the conventional tiles can have a uniform face pattern corresponding to the background pattern of at least one tile of the plurality of tiles 12. In these aspects, it is contemplated that one or more of the conventional tiles can have a uniform face pattern corresponding to the contrast pattern of at least one tile of the plurality of tiles 12. Exemplary floor coverings comprising "background" tiles, "contrast" tiles, and corner-oriented tiles are depicted in FIGS. 7A-9B. As depicted in FIGS. 7A-8B, in exemplary aspects, one or more corner-oriented tiles can be positioned so as to define a transition between uniform-pattern tiles, such as the "background" and "contrast" tiles described herein.

In certain exemplary aspects, the present disclosure provides for a tile having first and second end edges and first and second side edges, the distance between the first and second end edges of the tile corresponding to a length of the tile, the distance between the first and second side edges of the tile corresponding to a width of the tile, the first and second end edges being joined to the first and second side edges at four spaced corners, the tile comprising: a first portion having a background pattern comprising at least one color; a second portion having a contrast pattern intermixed with a portion of the background pattern, the contrast pattern comprising at least one color different than the at least one color of the background pattern; and a diagonal boundary line extending across the width of the tile from a first position on the first side edge of the tile to a second position on the second side edge of the tile, the boundary line substantially dividing the first portion of the tile from the second portion of the tile, wherein the first position on the first side edge is spaced from the first end edge by a first distance, wherein the second position on the second side edge is spaced from the second end edge by a second distance, and wherein the first distance is substantially equal to the second distance, wherein the contrast pattern is configured to emphasize the location of a selected corner of the tile. In a further exemplary aspect, the first portion comprises a boundary zone, the boundary zone corresponding to the portion of the first portion positioned within a predetermined distance of the boundary line, wherein a portion of the contrast pattern extends from the second portion into the boundary zone of the first portion. In a further exemplary aspect, the tile is square. In a further exemplary aspect, the ratio between the length of the tile and the predetermined distance ranges from about 2:1 to about 20:1. In a further exemplary aspect, the ratio between the length of the tile and the predetermined distance is about 3:1. In a further exemplary aspect, the ratio between the width of the tile and the predetermined distance ranges from about 2:1 to about 20:1. In a further exemplary aspect, the ratio between the width of the tile and the predetermined distance is about 3:1. In a further exemplary aspect, the ratio between the length of the tile and the first distance and the ratio between the length of the tile and the second distance both range from about 1.2:1 to about 10:1. In a further exemplary aspect, the ratio between the width of the tile and the first distance and the ratio between the width of the tile and the second distance both range from about 1.2:1 to about 10:1. In a further exemplary aspect, the area of the first portion of the tile is substantially equal to the area of the second portion of the tile. In a further exemplary aspect, at least a portion of the contrast pattern extends to the first side edge, the second side edge, and the first end edge. In a further exemplary aspect, the carpet tile is substantially rectangular. In a further exemplary aspect, the tile is a vinyl tile. In a further exemplary aspect, the tile is a carpet tile and, even further, the contrast pattern is formed from a plurality of yarn tufts, and wherein at least some of the yarn tufts of the at least one contrast color have a height greater than at least some of the yarn tufts of the at least one color of the background pattern proximate the yarn tufts of the at least one contrast color. In a further exemplary aspect, the contrast pattern has a speckled appearance. In a further exemplary aspect, the contrast pattern is randomized.

In certain other exemplary aspects, the present disclosure provides for a tile system, comprising: a plurality of tiles, each tile having first and second end edges and first and second side edges, the distance between the first and second end edges of the tile corresponding to a length of the tile, the distance between the first and second side edges of the tile corresponding to a width of the tile, the first and second end edges being joined to the first and second side edges at four spaced corners, each tile comprising: a first portion having a background pattern comprising at least one color; a second portion having a contrast pattern intermixed with a portion of the background pattern, the contrast pattern comprising at least one color different than the at least one color of the background pattern; and a diagonal boundary line extending across the width of the tile from a first position on the first side edge of the tile to a second position on the second side edge of the tile, the boundary line substantially dividing the first portion of the tile from the second portion of the tile, wherein the first position on the first side edge is spaced from the first end edge by a first distance, wherein the second position on the second side edge is spaced from the second end edge by a second distance, and wherein the first distance is substantially equal to the second distance, wherein the contrast pattern is configured to emphasize the location of a selected corner of the tile, and wherein the plurality of tiles are configured for selective positioning relative to one another such that the contrast pattern of each tile has a desired visual appearance relative to the contrast patterns of adjacent tiles, and wherein the plurality of tiles are configured to cooperatively define a surface covering.

In certain other exemplary aspects, the present disclosure provides for a method for forming a surface covering, the method comprising: providing a plurality of tiles, each tile having first and second end edges and first and second side edges, the distance between the first and second end edges of the tile corresponding to a length of the tile, the distance between the first and second side edges of the tile corresponding to a width of the tile, the first and second end edges being joined to the first and second side edges at four spaced corners, each tile comprising: a first portion having a background pattern comprising at least one color; a second portion having a contrast pattern intermixed with a portion of the background pattern, the contrast pattern comprising at least one color different than the at least one color of the background pattern; and a diagonal boundary line extending across the width of the tile from a first position on the first side edge of the tile to a second position on the second side edge of the tile, the boundary line substantially dividing the first portion of the tile from the second portion of the tile, wherein the first position on the first side edge is spaced from the first end edge by a first distance, wherein the second position on the second side edge is spaced from the second end edge by a second distance, and wherein the first distance is substantially equal to the second distance, and wherein the contrast pattern is configured to emphasize the location of a selected corner of the tile; and selectively positioning the plurality of tiles relative to one another thereon a hard surface such that the contrast pattern of each tile has a desired visual appearance relative to the contrast pattern of adjacent tiles, wherein the plurality of tiles cooperate to define the surface covering.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is therefore understood that the invention is not limited to the specific embodiments disclosed herein, and that many modifications and other embodiments of the invention are intended to be included within the scope of the invention. Moreover, although specific terms are employed herein, they are used only in a generic and descriptive sense, and not for the purposes of limiting the described invention.

What is claimed is:

1. A carpet tile having first and second end edges and first and second side edges, the distance between the first and second end edges of the tile corresponding to a length of the tile, the distance between the first and second side edges of the tile corresponding to a width of the tile, the first and second end edges being joined to the first and second side edges at four spaced corners, the tile comprising:

a first portion and a second portion, wherein the first portion and the second portion are defined by a diagonal boundary line extending across the width of the tile from a first position on the first side edge of the tile to a second position on the second side edge of the tile, wherein the first position on the first side edge is spaced from the first end edge by a first distance, wherein the second position on the second side edge is spaced from the second end edge by a second distance, wherein the first distance is substantially equal to the second distance, and wherein:

the first portion comprises a background pattern comprising at least one color; and the second portion comprises a contrast pattern intermixed with a portion of the background pattern, the contrast pattern comprising at least one contrast color different than the at least one color of the background pattern; and wherein the combined first portion and second portion cooperate to form a corner-oriented contrast pattern region.

2. The carpet tile of claim 1, wherein the first portion comprises a boundary zone, the boundary zone corresponding to the portion of the first portion positioned within a predetermined distance of the boundary line, wherein a portion of the contrast pattern extends from the second portion into the boundary zone of the first portion.

3. The carpet tile of claim 2, wherein the tile is square.

4. The carpet tile of claim 3, wherein the ratio between the length of the tile and the predetermined distance ranges from about 2:1 to about 20:1.

5. The carpet tile of claim 3, wherein the ratio between the length of the tile and the predetermined distance is about 3:1.

6. The carpet tile of claim 3, wherein the ratio between the width of the tile and the predetermined distance ranges from about 2:1 to about 20:1.

7. The carpet tile of claim 3, wherein the ratio between the width of the tile and the predetermined distance is about 3:1.

8. The carpet tile of claim 3, wherein the ratio between the length of the tile and the first distance and the ratio between the length of the tile and the second distance both range from about 1.2:1 to about 10:1.

9. The carpet tile of claim 3, wherein the ratio between the width of the tile and the first distance and the ratio between the width of the tile and the second distance both range from about 1.2:1 to about 10:1.

10. The carpet tile of claim 1, wherein the area of the first portion of the tile is substantially equal to the area of the second portion of the tile.

11. The carpet tile of claim 1, wherein at least a portion of the contrast pattern extends to the first side edge, the second side edge, and the first end edge.

12. The carpet tile of claim 1, wherein the carpet tile is substantially rectangular.

13. The carpet tile of claim 1, wherein the contrast pattern is formed from a plurality of yarn tufts, and wherein at least some of the yarn tufts of the at least one contrast color have a height greater than at least some of the yarn tufts of the at least one color of the background pattern proximate the yarn tufts of the at least one contrast color.

14. The carpet tile of claim 1, wherein the contrast pattern has a speckled appearance.

15. The carpet tile of claim 1, wherein the contrast pattern is randomized.

16. A carpet tile system, comprising:

a plurality of carpet tiles, each tile having first and second end edges and first and second side edges, the distance between the first and second end edges of the tile corresponding to a length of the tile, the distance between the first and second side edges of the tile corresponding to a width of the tile, the first and second end edges being joined to the first and second side edges at four spaced corners, wherein the plurality of carpet tiles comprises at least one corner-oriented tile, each corner-oriented tile comprising:

a first portion and a second portion, wherein the first portion and the second portion are defined by a diagonal boundary line extending across the width of the tile from a first position on the first side edge of the tile to a second position on the second side edge of the tile, wherein the first position on the first side edge is spaced from the first end edge by a first distance, wherein the second position on the second side edge is spaced from the second end edge by a second distance, wherein the first distance is substantially equal to the second distance, and wherein:

the first portion comprises a background pattern comprising at least one color; and the second portion comprises a contrast pattern intermixed with a portion of the background pattern, the contrast pattern comprising at least one contrast color different than the at least one color of the background pattern, wherein the combined first portion and second portion cooperate to form a corner-oriented contrast pattern region, wherein the plurality of carpet tiles are configured for selective positioning relative to one another such that the contrast pattern of each corner-oriented tile has a desired visual appearance relative to adjacent tiles, and wherein the plurality of carpet tiles are configured to cooperatively define a surface covering.

17. A method for forming a surface covering, the method comprising:

providing a plurality of carpet tiles, each tile having first and second end edges and first and second side edges, the distance between the first and second end edges of the tile corresponding to a length of the tile, the distance between the first and second side edges of the tile corresponding to a width of the tile, the first and second end edges being joined to the first and second side edges at four spaced corners, wherein the plurality of carpet tiles comprises at least one corner-oriented tile, each corner-oriented tile comprising:

a first portion and a second portion, wherein the first portion and the second portion are defined by a diagonal boundary line extending across the width of the tile from a first position on the first side edge of the tile to a second position on the second side edge of the tile, wherein the first position on the first side edge is spaced from the first end edge by a first distance, wherein the second position on the second side edge is spaced from the second end edge by a second distance, wherein the first distance is substantially equal to the second distance, and wherein:

the first portion comprises a background pattern comprising at least one color; and the second portion comprises a contrast pattern intermixed with a portion of the background pattern, the contrast pattern comprising at least one contrast color different than the at least one color of the background pattern, wherein the combined first portion and second portion cooperate to form a corner-oriented contrast pattern region; and selectively positioning the plurality of carpet tiles relative to one another thereon a hard surface such that the contrast pattern of each corner-oriented tile has a desired visual appearance relative to adjacent tiles, wherein the plurality of carpet tiles cooperate to define the surface covering.

18. The carpet tile system of claim 16, wherein the plurality of carpet tiles comprises a plurality of corner-oriented tiles.

19. The carpet tile system of claim 16, wherein the plurality of carpet tiles comprises at least one tile having a uniform face pattern.

20. The carpet tile system of claim 19, wherein the plurality of carpet tiles comprises a plurality of corner-oriented tiles.

21. The method of claim 17, wherein the plurality of carpet tiles comprises a plurality of corner-oriented tiles.

22. The method of claim 17, wherein the plurality of carpet tiles comprises at least one tile having a uniform face pattern.

23. The method of claim 22, wherein the plurality of carpet tiles comprises a plurality of corner-oriented tiles.

* * * * *